US008356411B2

(12) United States Patent
Hill, Jr. et al.

(10) Patent No.: US 8,356,411 B2
(45) Date of Patent: Jan. 22, 2013

(54) EXHAUST MANIFOLD WITH HYBRID CONSTRUCTION AND METHOD

(75) Inventors: Frederick B. Hill, Jr., Clarkston, MI (US); Sreedhar V. Chanda, Pontiac, MI (US)

(73) Assignee: Benteler Automotive Corporation, Auburn Hill, MI (US)

( * ) Notice: Subject to any disclaimer, the term of this patent is extended or adjusted under 35 U.S.C. 154(b) by 712 days.

(21) Appl. No.: 12/384,589

(22) Filed: Apr. 7, 2009

(65) Prior Publication Data

US 2009/0282820 A1 Nov. 19, 2009

Related U.S. Application Data

(60) Provisional application No. 61/123,252, filed on Apr. 7, 2008.

(51) Int. Cl.
*B21D 51/16* (2006.01)

(52) U.S. Cl. ..... 29/890.08; 60/323

(58) Field of Classification Search ..... 29/890.08; 60/323

See application file for complete search history.

(56) References Cited

U.S. PATENT DOCUMENTS

| | | | | |
|---|---|---|---|---|
| 2,713,195 | A * | 7/1955 | Hemmer | 29/890.052 |
| 3,324,533 | A * | 6/1967 | Watteau | 29/890.08 |
| 3,667,432 | A * | 6/1972 | Greathouse | 123/184.38 |
| 4,373,331 | A | 2/1983 | Santiago et al. | |
| 4,386,586 | A * | 6/1983 | Santiago et al. | 60/323 |
| 4,537,027 | A * | 8/1985 | Harwood et al. | 60/323 |
| 4,777,708 | A * | 10/1988 | Harwood et al. | 29/890.08 |
| 4,850,189 | A | 7/1989 | Arthur et al. | |
| 5,729,975 | A * | 3/1998 | Bekkering | 60/323 |
| 5,916,137 | A | 6/1999 | Hayashi | |
| 6,256,990 | B1 | 7/2001 | Itoh | |
| 6,474,697 | B2 | 11/2002 | Nording et al. | |
| 6,604,358 | B2 | 8/2003 | Durr et al. | |
| 6,651,425 | B2 | 11/2003 | Kenyon et al. | |
| 6,789,386 | B1 | 9/2004 | Haerle | |
| 7,252,177 | B2 | 8/2007 | Minato | |
| 2005/0183414 | A1 * | 8/2005 | Bien et al. | 60/323 |

FOREIGN PATENT DOCUMENTS

DE 10358107 A1 * 7/2005

OTHER PUBLICATIONS

Machine Translation of De10358107A1.*

* cited by examiner

*Primary Examiner* — David Bryant
*Assistant Examiner* — Jacob Cigna
(74) *Attorney, Agent, or Firm* — Rader, Fishman & Grauer, PLLC

(57) ABSTRACT

An exhaust manifold and related method have a hybrid clamshell construction including an outer manifold half stamped from a first metal and having a first wall thickness, as well as an inner manifold half stamped from a second metal that is different from the first metal and has a second wall thickness which is different from the first wall thickness. Opposite side edges of the outer and inner manifold halves are rigidly interconnected to define a hollow manifold bottom. Port and outlet flanges are rigidly attached to inlet and outlet sides of the manifold body.

17 Claims, 4 Drawing Sheets

EXHAUST MANIFOLD WITH HYBRID CONSTRUCTION AND METHOD

CLAIM OF PRIORITY

Applicants hereby claim the priority benefits under the provisions of 35 U.S.C. § 119, basing said claim of priority on U.S. Provisional Patent Application 61/123,252, filed Apr. 7, 2008.

BACKGROUND OF THE INVENTION

The present invention relates to exhaust manifolds for internal combustion engines and the like, and in particular to a hybrid clamshell construction and method therefor.

Exhaust manifolds for internal combustion engines are well known in the art, and serve to direct the flow of exhaust gases from the engine heads or exhaust ports to the atmosphere through an exhaust system, which may include catalytic converters, mufflers, tailpipes and the like. Since exhaust manifolds are exposed to extremely high temperatures during operation, and experience temperature fluctuations during use, they typically have a very heavy-duty, one-piece, cast iron construction. Different portions of the exhaust manifold are subjected to a variety of different temperatures, depending upon their proximity to the engine head or exhaust port, exhaust back pressure in the system, manifold wall thickness, and other dynamics of the flow of exhaust gases through the manifold. These localized temperature gradients, and the geometry of the manifold, generate substantial stress and strain within the manifold itself, which must be considered during the design of the manifold to ensure sufficient durability and efficient exhaust gas flow. The cycling of the manifold between extremely hot operating temperatures and cool ambient temperatures can also result in thermal fatigue which weakens the manifold, and can adversely impact the engine exhaust gas dynamics, as well as engine efficiency itself.

SUMMARY OF THE INVENTION

One aspect of the present invention is an exhaust manifold construction for internal combustion engines and the like, including an outer manifold half having a half clamshell shape with opposite side edges, and being stamped from a first metal sheet having a first wall thickness, and being constructed from a first metallic material. An inner manifold half has a half clamshell shape which mates with the shape of the outer manifold half, and includes opposite side edges, and is stamped from a second metal sheet having a second wall thickness which is different from the first wall thickness and is constructed from a second metallic material which is different from the first metallic material. The opposite side edges of the outer manifold half and the inner manifold half are rigidly joined together to define a hollow exhaust manifold body having an inlet side and outlet side. A port flange is rigidly connected with the inner manifold half along the inlet side of the exhaust manifold body, and an outlet flange is rigidly connected with the outer manifold half and the inner manifold half at the outlet side of the exhaust manifold body.

Another aspect of the present invention is a method for making an exhaust manifold for internal combustion engines and the like, including the steps of selecting a first metal sheet having a first wall thickness, and being constructed from a first metallic material, and stamping from the first metal sheet an outer manifold half having a half clamshell shape with opposite side edges. The method also includes selecting a second metal sheet having a second wall thickness which is different from the first wall thickness, and is constructed from a second metallic material which is different from the first metallic material. The method further includes stamping from the second metal sheet an inner manifold half having a half clamshell shape which mates with the shape of the outer manifold half, and includes opposite side edges. The method further includes rigidly joining the opposite side edges of the outer manifold half and the inner manifold half to define a hollow exhaust manifold body having an inlet side and an outlet side. The method also includes forming a port flange, and rigidly connecting the same to the inner manifold half along the inlet side of the exhaust manifold body, and forming an outlet flange, and rigidly connecting the same to the outer manifold half and the inner manifold half at the outlet side of the exhaust manifold body.

Yet another aspect of the present invention is an improved method for making an exhaust manifold for internal combustion engines and the like, which includes the steps of selecting a first metal sheet having a first wall thickness, and being constructed from a first metallic material, and stamping from the first metal sheet an outer manifold half having a half clamshell shape with opposite side edges. The improved method also includes selecting a second metal sheet having a second wall thickness which is different from the first wall thickness, and is constructed from a second metallic material which is different from the first metallic material. The improved method also includes stamping from the second metal sheet an inner manifold half having a half clamshell shape which mates with the shape of the outer manifold half, and includes opposite side edges. The improved method also includes rigidly joining the opposite side edges of the outer manifold half and the inner manifold half to define a hollow exhaust manifold body.

Yet another aspect of the present invention is an exhaust manifold and method having a hybrid clamshell construction that is readily adaptable for a wide variety of applications, and provides superior structural integrity and resistance to thermal fatigue. The extreme thermal stress/strain, which causes cracking failures, is significantly reduced by virtue of the hybrid clamshell design.

Yet another aspect of the present invention is a multi-piece, fabricated exhaust manifold construction and method, which permits making different areas of the manifold from different metals, and various wall thicknesses, so as to optimize performance and minimize manufacturing cost.

Yet another aspect of the present invention is to provide a hybrid clamshell construction for exhaust manifolds that is efficient in use, economical to manufacture, capable of long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
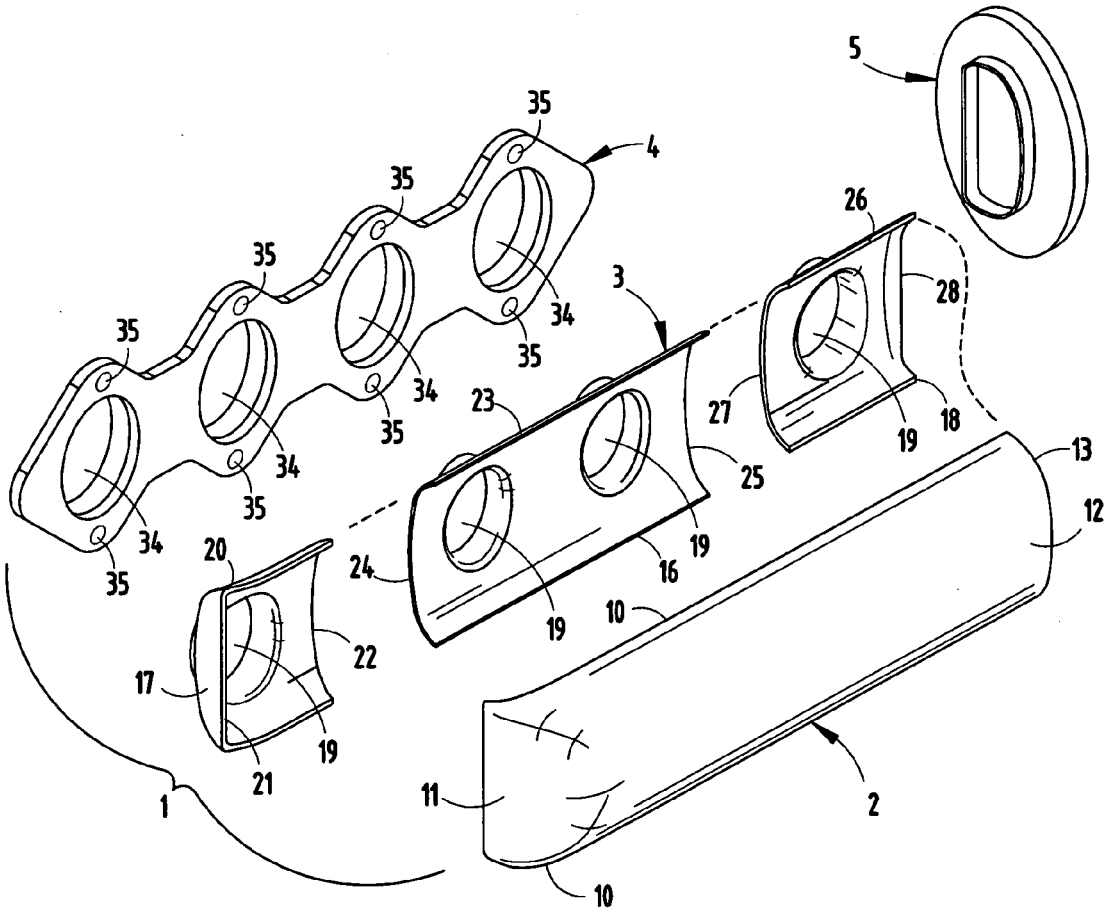
FIG. 1 is an exploded perspective view of an exhaust manifold embodying the present invention, taken from an outer side thereof.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In general, the disclosed hybrid clamshell exhaust manifold construction comprises a plurality of individually formed sections of stainless steel or the like, which are welded or otherwise rigidly joined together to define a complete fabricated manifold 1. Because of the multi-piece construction, different areas of the exhaust manifold 1 can be made from different types of steel using different thicknesses and port flange geometries, so as to optimize performance and minimize cost.

Figure 2:
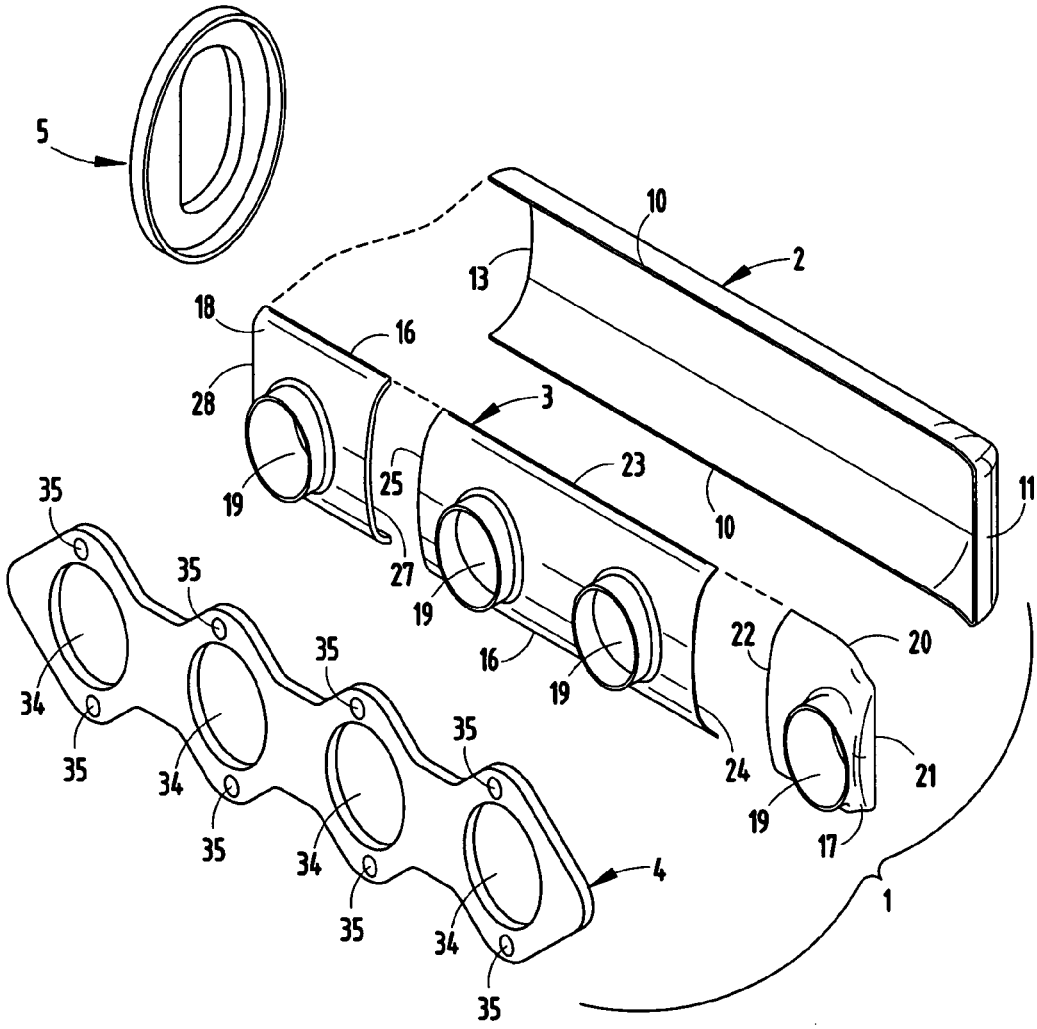
FIG. 2 is an exploded perspective view of the exhaust manifold, taken from an inner side thereof.

With reference to FIGS. 1 and 2, the illustrated exhaust manifold 1 has a multi-piece clamshell construction, comprising an outer manifold half 2, an inner manifold half 3, an inlet flange 4 and an outlet flange 5, which are all rigidly interconnected.

In the illustrated example, outer manifold half 2 (FIGS. 1 and 2) has a half clamshell shape with opposite side edges 10. Outer manifold half 2 is stamped from a first metal sheet having a first wall thickness, and being constructed from a first metallic material. Outer manifold half 2 has a generally arcuate configuration, with a forward end 11 and a rearward end 12. The forward end 11 of outer manifold half 2 is arcuately-shaped and tapers inwardly toward inner manifold half 3, while the rearward end 12 has a generally flat end edge 13. The illustrated outer manifold half 2 is one-piece, and is constructed from 409 stainless steel having a thickness of 1.8 millimeters.

Figure 3:
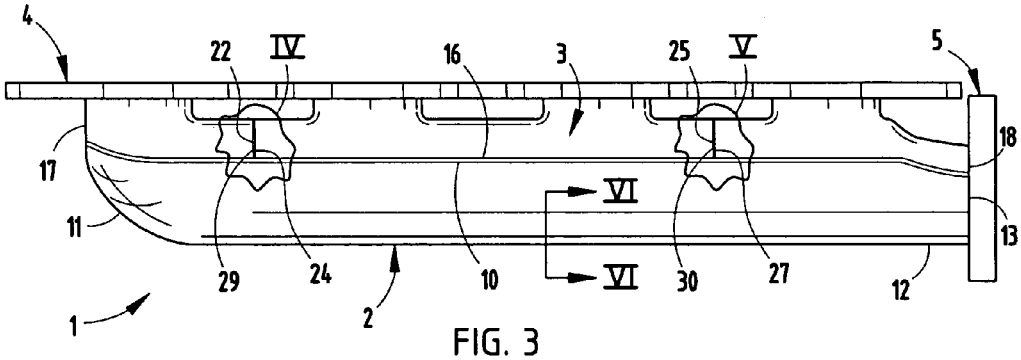
FIG. 3 is a top plan view of the exhaust manifold.
Figure 4:
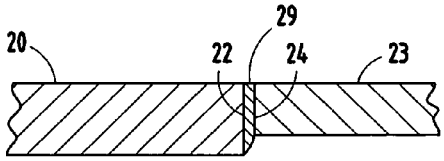
FIG. 4 is a fragmentary, enlarged cross-sectional view of the exhaust manifold, taken from the balloon IV-IV, FIG. 3.
Figure 5:
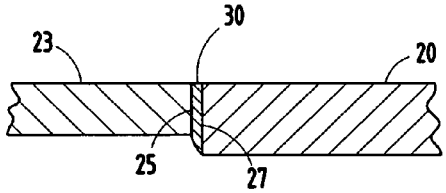
FIG. 5 is a fragmentary, enlarged cross-sectional view of the exhaust manifold, taken from the balloon V-V, FIG. 3.
Figure 6:
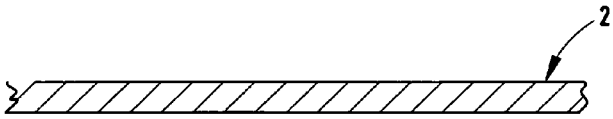
FIG. 6 is a fragmentary, enlarged cross-sectional view of the exhaust manifold, taken along the line VI-VI, FIG. 6.

In the illustrated example, inner manifold half 3 (FIGS. 1 and 2) has a half clamshell shape which mates with the shape of outer manifold half 2, and includes opposite side edges 16. Inner manifold half 3 is stamped from a second metal sheet having a second wall thickness which is different from the first wall thickness, and is constructed from a second metallic material which is different from the first metallic material. Inner manifold half 3 has a generally arcuate configuration, with a forward end 17 and a rearward end 18. Inner manifold half 3 has four laterally extending apertures 19 which are spaced to align with the exhaust ports of an associated internal combustion engine. In the illustrated example, inner manifold half 3 has a three-piece construction, comprising an upstream end 20 with opposite end edges 21 and 22, a center section 23 with opposite end edges 24 and 25, and a downstream end 26 with opposite end edges 27 and 28. The end edges 22, 24, 25 and 27 of inner manifold portions 20, 23 and 26 are rigidly interconnected along associated joints 29 and 30 (FIGS. 3-5) to define inner manifold half 3. In the illustrated example, the upstream end 20 of inner manifold half 3 is constructed from 441 stainless steel having a thickness of 2.2 millimeters, whereas center section 23 is constructed from 409 stainless steel having a thickness of 2.0 millimeters, and downstream end 26 is constructed from 441 stainless steel having a thickness of 2.2 millimeters. The outer manifold half 2 and various pieces 20, 23 and 26 of inner manifold half 3 are individually stamped to shape, and then welded together or otherwise rigidly interconnected to define a hollow exhaust manifold body having an oval-shaped internal cavity.

In one working embodiment of the present invention, the wall thickness of parts 2, 20, 23 and 26 is varied between around 1.5-2.5 millimeters, and metal selections include 409, 439, 441 and 444 stainless steels, although other variations are also contemplated. In the subject working embodiment, it was found that extreme thermal stress and strain, which cause cracking failures, was reduced by careful selection of the material and geometry. The vertical part line 2 in the clamshell construction allows the use of a combination of stainless steels, wall thicknesses and port flange geometry.

In the example shown in FIGS. 3-6, the upstream inner manifold section 20 is constructed from 441 stainless steel having a wall thickness of 2.2 millimeters, the center section 23 is constructed from 409 stainless steel having a wall thickness of 2.0 millimeters, and the downstream section 26 is constructed from 441 stainless steel having a wall thickness of 2.2 millimeters. The adjacent end edges 22, 24, 25 and 27 of inner manifold sections 20, 23, and 26 are welded together along joints 29 and 30, which can be of different styles, such as overlapped, butt joints, or the like. The illustrated outer manifold half 2 is constructed from 409 stainless steel having a wall thickness of 1.8 millimeters, and is welded to inner manifold half 3 along opposite side edges 10 and 16.

In the example illustrated in FIGS. 1-6, port flange 4 has a one-piece construction, and is rigidly attached to inner manifold half 3 by welding or other similar techniques. The illustrated port flange 4 is generally flat or plate-shaped, with four spaced through apertures 34 which align with apertures 19 in inner manifold half 3, as well as the exhaust ports in the associated engine head (not shown). Port flange 4 also has eight fastener apertures 35 through which bolts (not shown) extend to mount exhaust manifold 1 to the engine. Preferably, a plurality of port flanges 4 are fabricated, each being adapted for connection with an associated inner manifold half 3, yet having a different port flange geometry for use in one of a variety of different predetermined applications, as shown in FIGS. 8 and 9. More specifically, the port flange 4*a* shown in FIG. 8 has three, generally obround slots or openings 45*a* formed between the four exhaust inlet ports, whereas the port flange 4*b* shown in FIG. 7 has three, generally circular openings 45*b* formed between the four exhaust inlet ports. It is to be understood that port flange 4 can be provided with a wide variety of port flange geometries to effect structure, spring rate, thermal expansion and other similar factors to thereby accommodate various applications.

Similarly, the illustrated outlet flange 5 has a one-piece construction, and is rigidly attached to both the outer manifold half 2 and the inner manifold half 3 by welding or other similar techniques. Preferably, a plurality of outlet flanges 5 are provided with each being configured for attachment to both the outer and inner manifold halves, and having a different mount configuration for use in a variety of different predetermined applications.

Figure 7:
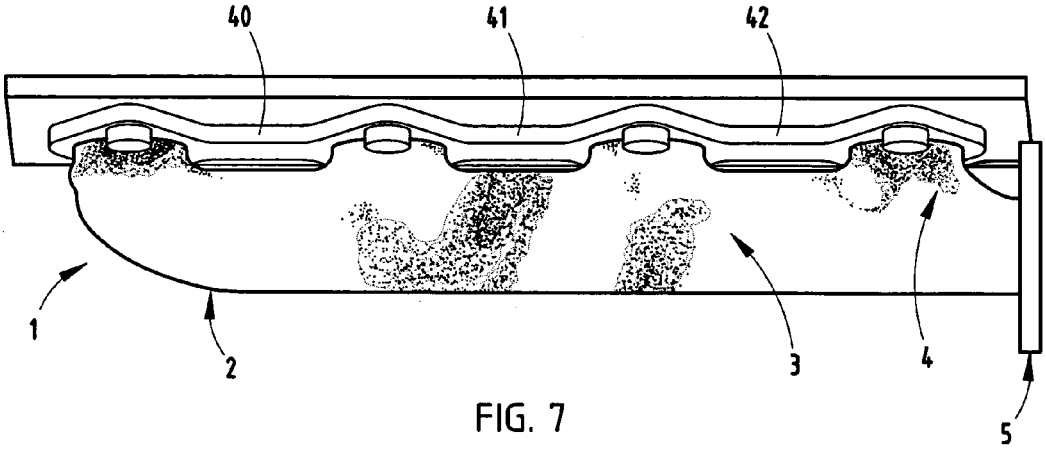
FIG. 7 is a top plan view of the exhaust manifold, showing in color the projected strain pattern during operation.
Figure 8:
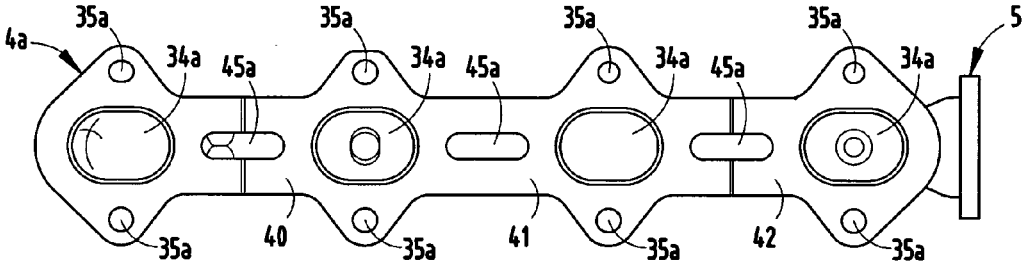
FIG. 8 is a side elevational view of an alternative port flange portion of the exhaust manifold.
Figure 9:
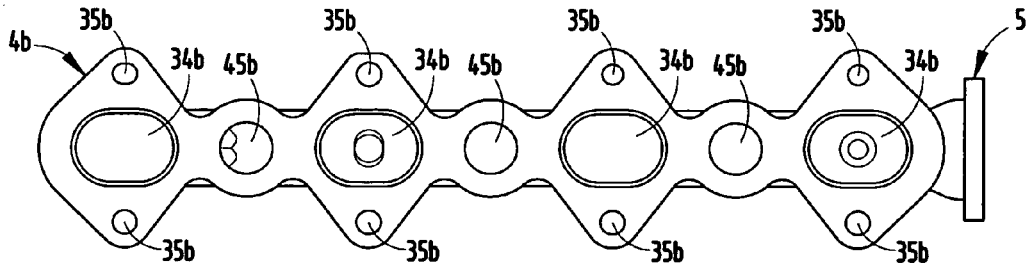
FIG. 9 is a side elevational view of another alternative port flange portion of the exhaust manifold.

In the example illustrated in FIGS. 7 and 8, port flanges 4, 4*a* have a longitudinally split, multi-piece construction. In the illustrated examples, port flanges 4, 4*a* have three separate pieces 40, 41 and 42 with opposite end edges thereof rigidly interconnected along vertical joints by welding or the like to form port flanges 4 and 4*a*. The material from which each of the various port flange pieces 40-42 are constructed is varied depending upon a particular application, so as to achieve necessary strength using the least expensive material. For example, the material used for port flange piece 40 can have a lower tensile strength than the material used for port flange pieces 40 and 42.

The multi-piece, fabricated construction of exhaust manifold 1 provides superior design flexibility to adapt the same readily for a wide variety of different applications, and to contemporaneously minimize cost. For example, the porting dynamics of exhaust manifold 1 can be readily altered by simply changing the interior shape and/or wall thickness of one or more of the various parts 2-5, without changing the design of the remaining parts. Modification of the geometry of port flange 8 has a significant effect on manifold thermal stress. Also, manufacturing costs can be reduced by using thicker pieces of higher grade metal at only those areas experiencing maximum stress and strain.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method for making an exhaust manifold for internal combustion engines and the like, including:

selecting a first metal sheet having a first wall thickness, and being constructed from a first metallic material;

stamping from the first metal sheet an outer manifold half having a half clamshell shape with opposite side edges;

selecting a second metal sheet having a second wall thickness which is different from the first wall thickness, and being constructed from a second metallic material which is different from the first metallic material;

stamping from the second metal sheet an inner manifold half having a half clamshell shape which mates with the shape of the outer manifold half, and includes opposite side edges;

rigidly joining the opposite side edges of the outer manifold half and the inner manifold half to define a hollow exhaust manifold body having an inlet side and an outlet side;

forming a port flange, and rigidly connecting the same to the inner manifold half along the inlet side of the exhaust manifold body; and forming an outlet flange, and rigidly connecting the same to the outer manifold half and the inner manifold half at the outlet side of the exhaust manifold body;

fabricating the inner manifold half in a plurality of separate pieces, wherein a first of the inner manifold pieces is stamped from the second metal sheet with the second wall thickness, and constructed of the second metallic material; and including stamping a second of the inner manifold pieces from a third metal sheet having a third wall thickness which is different from the second wall thickness, and constructed from a third metallic material that is different from the second metallic material; and rigidly joining adjacent end edges of the first and second inner manifold pieces to define the inner manifold.

2. A method as set forth in claim 1, wherein:

said fabricating step further includes:

stamping a third inner manifold piece from a fourth metal sheet having a fourth wall thickness which is different from the third wall thickness, and is constructed from a fourth metallic material that is different from the third metallic material; and rigidly joining adjacent end edges of the second and third inner manifold pieces to define the inner manifold.

3. A method as set forth in claim 2, wherein:

said port flange forming step comprises forming a plurality of port flanges, each configured for attachment to the inner manifold half, and having a different port flange geometry for use in one of a variety of predetermined applications.

4. A method as set forth in claim 3, wherein:

said outlet flange forming step comprises forming a plurality of outlet flanges, each configured for attachment to the outer manifold half and the inner manifold half, and having a different mount configuration for use in one of a variety of predetermined applications.

5. A method as set forth in claim 4, wherein:

said second metal sheet selecting step further comprises selecting the second, third and fourth metal sheets with the second, third and fourth wall thicknesses greater than the first wall thickness of the first metal sheet.

6. A method as set forth in claim 5, wherein:

said second metal sheet selecting step further comprises selecting at least one of the second, third and fourth metallic materials with a greater tensile strength than the first metallic material.

7. A method as set forth in claim 6, wherein:

said first metal sheet selecting step comprises selecting the first metallic material from 409 stainless steel, with the first wall thickness in the range of 1.2-2.2 millimeters.

8. A method as set forth in claim 7, wherein:

said second metal sheet selecting step comprises selecting the second metallic material from 441 stainless steel, with the second wall thickness in the range of 1.6-2.6, millimeters.

9. A method as set forth in claim 8, wherein:

said third metal sheet selecting step comprises selecting the third metallic material from 409 stainless steel, with the third wall thickness in the range of 1.4-2.4 millimeters.

10. A method as set forth in claim 9, wherein:

said fourth metal sheet selecting step comprises selecting the fourth metallic material from 441 stainless steel, with the fourth wall thickness in the range of 1.6-2.6 millimeters.

11. A method as set forth in claim 10, wherein:

said port flange forming step includes fabricating the port flange in a plurality of separate, longitudinally adjacent pieces and rigidly joining adjacent end edges of the port flange pieces to define the port flange.

12. A method as set forth in claim 11, wherein:

said port flange fabricating step comprises forming the longitudinally adjacent pieces from different materials.

13. A method for making an exhaust manifold for internal combustion engines and the like, including:

selecting a first metal sheet having a first wall thickness, and being constructed from a first metallic material;

stamping from the first metal sheet an outer manifold half having a half clamshell shape with opposite side edges;

selecting a second metal sheet having a second wall thickness which is different from the first wall thickness, and being constructed from a second metallic material which is different from the first metallic material;

stamping from the second metal sheet an inner manifold half having a half clamshell shape which mates with the shape of the outer manifold half, and includes opposite side edges; and rigidly joining the opposite side edges of the outer manifold half and the inner manifold half to define a hollow exhaust manifold body;

fabricating the inner manifold half in a plurality of separate pieces, wherein a first of the inner manifold pieces is stamped from the second metal sheet with the second wall thickness, and constructed of the second metallic material; and including stamping a second of the inner manifold pieces from a third metal sheet having a third wall thickness which is different from the second wall thickness, and constructed from a third metallic material that is different from the second metallic material; and rigidly joining adjacent end edges of the first and second inner manifold pieces to define the inner manifold.

14. A method as set forth in claim 13, wherein:

said fabricating step further includes:

stamping a third inner manifold piece from a fourth metal sheet having a fourth wall thickness which is different from the third wall thickness, and constructed from a fourth metallic material that is different from the third metallic material; and rigidly joining adjacent end edges of the second and third inner manifold pieces to define the inner manifold.

15. A method as set forth in claim 14, wherein:

said second metal sheet selecting step further comprises selecting the second, third and fourth metal sheets with the second, third and fourth wall thicknesses greater than the first wall thickness of the first metal sheet.

16. A method as set forth in claim 15, wherein:

said second metal sheet selecting step further comprises selecting at least one of the second, third and fourth metallic materials with a greater tensile strength than the first metallic material.

17. A method as set forth in claim 16, wherein:

said port flange forming step includes fabricating the port flange in a plurality of separate, longitudinally adjacent pieces constructed from different materials and rigidly joining adjacent end edges of the port flange pieces to define the port flange.

* * * * *